United States Patent [19]

Briceno et al.

[11] Patent Number: 4,895,641

[45] Date of Patent: Jan. 23, 1990

[54] METHOD OF DESALTING CRUDE OIL

[76] Inventors: Maria I. Briceno, Caricuao, Sector CC-2, Bloque 4, Apt. 03-01; Maria L. Chirinos, Ur. Santa Paula, Calle Pluton Qta., both of Caracus, Venezuela; Alistair S. Taylor, 11 Stockbridge Way, Yateley, Camberley, Surrey, GU17 7BS; Spencer E. Taylor, 32 Martindale Avenue, Heatherside, Camberley, Surrey, GU15 1BD, both of England

[21] Appl. No.: 387,417

[22] Filed: Jul. 31, 1989

Related U.S. Application Data

[63] Continuation of Ser. No. 804,189, Dec. 3, 1985, abandoned.

[30] Foreign Application Priority Data

Dec. 7, 1984 [GB] United Kingdom ..... 8431013

[51] Int. Cl.[4] ..... C10G 19/00

[52] U.S. Cl. ..... 208/286; 208/188; 208/177; 208/289; 208/291; 208/290; 208/262.1; 210/708

[58] Field of Search ..... 208/262, 286, 188, 177, 208/290, 291; 210/708

[56] References Cited

U.S. PATENT DOCUMENTS

| | | | |
|---|---|---|---|
| 2,481,300 | 9/1949 | Engel | 208/262 |
| 3,761,534 | 9/1973 | Sun et al. | 208/262 |
| 4,340,471 | 7/1982 | Jordan | 208/262 |
| 4,351,718 | 9/1982 | Brunelle | 208/262 |
| 4,353,793 | 10/1982 | Brunelle | 208/262 |
| 4,377,471 | 3/1983 | Brown et al. | 208/262 |
| 4,407,706 | 10/1983 | Merchant, Jr. et al. | 210/708 |
| 4,407,707 | 10/1983 | Merchant, Jr. et al. | 210/708 |
| 4,409,091 | 10/1983 | Kessick | 208/187 |
| 4,416,754 | 11/1983 | Merchant, Jr. et al. | 210/708 |
| 4,416,767 | 11/1983 | Jordan | 208/262 |
| 4,430,208 | 2/1984 | Pytlewski et al. | 208/262 |
| 4,447,667 | 5/1984 | Parker et al. | 208/262 |
| 4,539,100 | 9/1985 | Ronden | 210/708 |
| 4,551,239 | 11/1985 | Merchant et al. | 210/708 |
| 4,600,506 | 7/1986 | Dickakian | 210/708 |

FOREIGN PATENT DOCUMENTS 0156486 10/1985 European Pat. Off. .

*Primary Examiner*—Helane Myers

[57] ABSTRACT

The salt content of a heavy crude oil is reduced by a method which comprises the steps of (a) mixing 70 to 98% by volume of a heavy crude oil having a viscosity in the range 200 to 250,000 mPa.s at the mixing temperature with 30 to 2% by volume of an aqueous solution of an emulsifying surfactant or an alkali, percentages being expressed as percentages by volume of the total mixture; mixing being effected under low shear conditions in the range 10 to 1,000 reciprocal seconds, in such manner that an HIPR emulsion is formed comprising distorted oil droplets having mean droplet diameters in the range 2 to 50 micron separated by aqueous films, (b) breaking the resulting emulsion, and (c) separating the resulting mixture into a layer of relatively salt-free oil and a layer of relatively salt-enhanced water.

Heavy crude oils are desalted by the above method without requiring a hydrocarbon diluent.

The high surface area of the aqueous lamellae in the HIPR emulsion increases the probability of contacts occurring between them and the droplets of salt water originally present in the crude oil, and thus leads to greater desalting efficiency.

6 Claims, No Drawings

METHOD OF DESALTING CRUDE OIL

This is a continuation of co-pending application Ser. No. 06/804,189, filed on Dec. 3, 1985, now abandoned.

This invention relates to a method for desalting crude petroleum.

Crude oil is generally found in a reservoir in association with salt water and gas. The oil and gas occupy the upper part of the reservoir and below there may be a considerable volume of water, usually saline, which extends throughout the lower levels of the rock. As the reservoir becomes depleted, the oil/water interface in the reservoir rises and at some stage, water will be co-produced with the oil.

The mixture of water and oil is subjected to a high degree of turbulence as it flows through the well tubing and particularly as it passes through the well-head choke and other production facilities such as pumps. These actions form an emulsion in which water droplets are dispersed throughout the crude oil phase. The presence of indigenous surfactants in the crude oil also stabilises the emulsion by forming a rigid interfacial layer which prevents the water droplets from contacting and coalescing with one another.

Thus, following production, crude oil can contain water to a greater or lesser extent and this must be removed. The action of water removal is termed crude oil dehydration. Some emulsions may be broken down by heat alone but more often it is necessary to add a surface tension reducing chemical to achieve this end. Generally the application of heat and/or chemical is sufficient to reduce the water content, and more importantly the salt content, to an acceptable level but sometimes it is necessary to use electrostatic precipitation.

A dehydrated oil normally contains between 0.1 and 1.0% by vol. of water. However, if the salinity of the remaining water is high, the salt content of the crude oil will also be high eg between 100–500 ptb (pounds salt per 1000 barrels of crude oil (even when such low quantities of water are present. This is undesirable because the presence of salt reduces the value of the crude oil, leads to the corrosion of pipelines and fouling of downstream distillation columns and may poison catalysts used in downstream refining processes.

With most crude oils it is necessary to remove the salt from the crude oil by washing with fresh water or a low salinity aqueous phase, imparting a degree of mixing to ensure adequate contact between high salinity water in the crude and low salinity wash water and then carrying out the separation process by any of the means described above. This process is termed crude oil desalting.

The two processes of dehydration and desalting may both be carried out at the production location to give a crude with less than 1% water and 20 ptb salt. Furthermore, an additional desalting process may be carried out after the crude oil is received at a refinery.

Normally in desalting, a small amount (about 5% vol/vol) of fresh water or water of low salinity is added to the dehydrated crude oil. When this is the case, a high degree of mixing is often required to induce good contact between saline droplets, non- or low-saline droplets and added demulsifier. Consequently, the emulsion produced is very stable with a low average droplet size. This problem is intensified for heavy crude oils.

However, the emulsion can be destabilised and, assuming optimum mixing, the salt content can be reduced to as low as 2 ptb (6 ppm). In order to desalt to such low levels, however, it is necessary to use conditions of high temperature, a chemical demulsifier and often electrostatic separation. Demulsifiers usually comprise blends of surface active chemicals, e.g. ethoxylated phenolic resins, in a carrier solvent.

Heavy crude oils are generally diluted with lighter hydrocarbon fractions such as condensate or light crude oil before further treatment such as dehydration and desalting. The purpose of this is to reduce the viscosity of the oil phase to facilitate phase separation.

In the case of a system comprising dispersed spheres of equal size, the maximum internal phase volume occupied by a hexagonally close-packed arrangement is ca 74%. In practice, however, emulsions are rarely monodisperse and it is therefore possible to increase the packing density slightly without causing appreciable droplet distortion. Attempts to increase further the internal phase volume results in greater droplet deformation and, because of the larger interfacial area created, instability arises; this culminates in either phase inversion or emulsion breaking. Under exceptional circumstances, however, it is possible to create dispersions containing as high as 98% disperse phase volume without inversion or breaking.

Emulsified systems containing >70% internal phase are known as HIPR (High internal phase ratio) emulsions. HIPR oil/water emulsions are normally prepared by dispersing increased amounts of oil into the continuous phase until the internal phase volume exceeds 70%. Clearly, for very high internal phase volumes, the systems cannot contain discrete spherical oil droplets; rather, they will consist of highly distorted oil droplets, separated by thin interfacial aqueous films.

Our copending European patent application No. 0 156 486-A discloses a method for the preparation of an HIPR emulsion which method comprises directly mixing 70 to 98%, preferably 80 to 90%, by volume of a viscous oil having a viscosity in the range 200 to 250,000 mPa.s at the mixing temperature with 30 to 2%, preferably 20 to 10%, by volume of an aqueous solution of an emulsifying surfactant or an alkali, percentages being expressed as percentages by volume of the total mixture; mixing being effected under low shear conditions in the range of 10 to 1,000, preferably 50 to 250, reciprocal seconds in such manner that an emulsion is formed comprising highly distorted oil droplets having mean droplet diameters in the range 2 to 50 micron separated by thin interfacial films.

We have now discovered that heavy crude oils can be desalted effectively without requiring a hydrocarbon diluent by forming and subsequently breaking an HIPR emulsion.

Thus according to the present invention there is provided a method for reducing the salt content of a heavy crude oil which method comprises the steps of (a) mixing 70 to 98%, preferably 80 to 95%, by volume of a heavy crude oil having a viscosity in the range 200 to 250,000, preferably 2,000 to 250,000, mPa.s at the mixing temperature with 30 to 2%, preferably 20 to 5%, by volume of an aqueous solution of an emulsifying surfactant or an alkali, percentages being expressed as percentages by volume of the total mixture; mixing being effected under low shear conditions in the range 10 to 1,000, preferably 50 to 500, reciprocal seconds, in such manner that an HIPR emulsion is formed comprising distorted oil droplets having mean droplet diameters in the range 2 to 50, preferably 5 to 20, microns separated by aqueous films, (b) breaking the resulting emulsion, and (c) separating the resulting mixture into a layer of relatively salt-free oil and a layer of relatively salt-enhanced water.

Preferably the HIPR emulsion is diluted to an emulsion containing not more than 75%, preferably 60 to 75%, by volume of oil before breaking.

It is believed that an extensive network of thin, aqueous, surfactant films or lamellae is created throughout the oil phase, about which hydrophilic impurities in the crude oil are concentrated. Subsequent dilution of the HIPR emulsion with fresh water expands the surfactant lamellae and discharges the impurities into the continuous aqueous phase.

The diluted emulsion can be broken either by phase inversion, followed by treatment by conventional means such as electrostatic desalters, or, more preferably, by heating which eliminates the need for further treatment. Heating is preferably carried out at a temperature in the range 100° to 160° C.

The emulsifying surfactant is preferably employed in amount 1 to 5% by weight, based on the weight of the water.

Suitable emulsifying surfactants include ethoxylated alkyl phenols, ethoxylated secondary alcohols, ethoxylated sorbitan esters, ethoxylated amines and mixtures thereof.

Usually the droplet size distribution will be in a narrow range, i.e. the HIPR emulsions have a high degree of monodispersity.

The oil and aqueous surfactant may be mixed using equipment known to be suitable for mixing viscous fluids, see H. F. Irving and R. L. Saxton, Mixing Theory and Practice (Eds. V. W. Uhl and J. B. Gray), Vol 1, Chap 8, Academic Press, 1966. Static mixers may also be used.

For a given mixer, the droplet size can be controlled by varying any or all of the three main parameters: mixing speed, mixing time and surfactant concentration. Increasing any or all of these will decrease the droplet size.

Temperature is not significant except insofar as it affects the viscosity of the oil.

A particularly suitable mixer is a vessel having rotating arms. Suitably the speed of rotation is in the range 500 to 1,200 rpm. Below 500 rpm mixing is relatively ineffective and/or excessive mixing times are required.

Suitable mixing times are in the range 5 seconds to 10 minutes. Similar remarks to those made above in respect of the speed range also apply to the time range.

Suitable viscous, heavy and/or asphaltenic crude oils for treatment are to be found in Canada, the U.S.A. and Venezuela, for example Lake Marguerite crude oil from Alberta, Hewitt crude oil from Oklahoma and Cerro Negro crude oil from the Orinoco oil belt.

Generally the API gravity should be in the range 5° to 20°, although the method can be applied to crude oils outside this API range.

Desalting efficiency is governed primarily by the efficient mixing of a wash water phase with dispersed crude saline water droplets, and then the separation of the mixed droplets. In the formation of an HIPR emulsion, efficient dispersion of the introduced aqueous surfactant lamellae can be accomplished with low input of energy. In this situation, droplet-lamellae contact (as opposed to droplet-droplet contact in the conventional method) affects the desalting process. The fact that HIPR emulsions contain a large overall area of lamellae increases the probability of contacts occurring which in turn leads to greater desalting efficiency compared with conventional techniques.

The invention is illustrated with reference to the following Example.

EXAMPLE

Lake Marguerite crude oil (LMCO) was selected as a model heavy crude oil. It has an API Gravity of 10.3° and a viscosity of 19,800 mPa.s at 25° C. As produced, it may have a water content in the range 0 to 50% by vol. weight and a high salt content.

Free water and large droplets of emulsified water are usually allowed to settle out under gravity and high temperature conditions in a Free Water Knock Out vessel (FWKO). However, small droplets of emulsified water remain incorporated in the oil leaving the FWKO, typical residual water contents being in the range 0 to 10% by volume. Subsequent treatment usually involves dilution of the oil to lower the viscosity and density prior to gravitational and/or electrostatic separation.

In the present example, a sample of LMCO containing 2% by vol emulsified water and 17 ptb salt was used.

Since the specific gravity of the crude oil is close to unity, emulsions on a wt/wt basis are approximately the same numerically as those on a vol/vol basis.

Various 90% HIPR emulsions were prepared to illustrate the effect of oil droplet size on desalting efficiency.

The emulsions were prepared by adding 90 g LMCO to a 250 ml beaker containing 10 g of a 2.5% aqueous solution of a nonyl phenol ethoxylate containing ten ethylene oxide units per molecule. These were then mixed at 50° C. with a domestic mixer at 1200 rpm for 5, 10 and 20 seconds to produce dispersions of mean droplet diameters of 11, 9 and 7 microns respectively. The shear rate during mixing was a few hundred reciprocal seconds.

The emulsions were then demulsified by diluting with fresh water to 70% by weight oil and heating to 140° C. in a sealed container for 1 hour and isolating the separated layers. The quantity of salt remaining associated with each oil sample was then determined conductimetrically.

The following results were obtained.

| Emulsion Particle Size (microns) | Salt Content of Oil after Demulsification (ptb) | Desalting Efficiency % |
|---|---|---|
| 11 | 9.9 | 42 |
| 9 | 5.3 | 69 |
| 7 | 4.4 | 74 |

It can be seen that the greater the degree of dispersion, the lower is the salt content of the resolved LMCO.

We claim:

1. A method for reducing the salt content of a heavy crude oil which method comprises the steps of (a) mixing 70 to 98% by volume of a heavy crude oil having a viscosity in the range 200 to 25,000 mPa.s at the mixing temperature with 30 to 2% by volume of an aqueous solution of an emulsifying surfactant or an alkali, percentages being expressed as percentages by volume of the total mixture; mixing being effected under low shear conditions in the range 10 to 1,000 reciprocal seconds, in such manner that an HIPR emulsion is formed comprising distorted oil droplets having mean droplet diameters in the range 2 to 50 microns separated by aqueous films, (b) breaking the resulting emulsion, and (c) separating the resulting mixture into a layer of relatively salt-free oil and a layer of relatively salt-enhanced water.

2. A method according to claim 1 which method comprises the steps of (a) mixing 80 to 95% by volume of a heavy crude oil having a viscosity in the range 200 to 250,000 mPa.s at the mixing temperature with 20 to 5% by volume of an aqueous solution of an emulsifying surfactant or an alkali, percentages being expressed as percentages by volume of the total mixture; mixing being effected under low shear conditions in the range 50 to 500 reciprocal seconds, in such manner that an HIPR emulsion is formed comprising distorted oil droplets having mean droplet diameters in the range 5 to 20 microns separated by aqueous films, (b) breaking the resulting emulsion, and (c) separating the resulting mixture into a layer of relatively salt-free oil and a layer of relatively salt-enhanced water.

3. A method according to claim 1 wherein the HIPR emulsion is diluted to an emulsion containing not more than 75% by volume of oil before breaking.

4. A method according to claim 3 wherein the HIPR emulsion is diluted to an emulsion containing 60 to 75% by volume of oil before breaking.

5. A method according to claim 1 wherein the emulsion is broken by heating.

6. A method according to claim 5 wherein the emulsion is broken by heating to a temperature in the range 100° to 160° C.

* * * * *

UNITED STATES PATENT AND TRADEMARK OFFICE

CERTIFICATE OF CORRECTION

PATENT NO. : 4,895,641

DATED : January 23, 1990

INVENTOR(S) : Maria I. Briceno, et al

It is certified that error appears in the above-identified patent and that said Letters Patent is hereby corrected as shown below:

Col. 4, claim 1, line 65, "25,000" should read --250,000--.

Col. 5, claim 2, line 15, "200" should read --2000--.

Signed and Sealed this

Fourth Day of June, 1991

*Attest:*

HARRY F. MANBECK, JR.

*Attesting Officer*

*Commissioner of Patents and Trademarks*